US005964667A

United States Patent [19]

Brookman

[11] Patent Number: 5,964,667

[45] Date of Patent: Oct. 12, 1999

[54] NON-STICKING PUTTING CUP

[75] Inventor: Larry Brookman, Waterloo, Iowa

[73] Assignee: Standard Golf Company, Cedar Falls, Iowa

[21] Appl. No.: 08/956,580

[22] Filed: Oct. 23, 1997

[51] Int. Cl.[6] ..... A63B 57/00

[52] U.S. Cl. ..... 473/176; 473/175

[58] Field of Search ..... 473/173–179

[56] References Cited

U.S. PATENT DOCUMENTS

| | | | |
|---|---|---|---|
| 1,329,732 | 2/1920 | Verity | 473/176 |
| 1,675,089 | 6/1928 | Bloom | 473/176 |
| 1,676,954 | 7/1928 | Kannemann | 473/176 |
| 1,943,610 | 1/1934 | John | 473/176 |
| 3,348,797 | 10/1967 | Turbyfill | 473/176 |
| 4,114,879 | 9/1978 | Oiler | 273/34 R |
| 4,878,665 | 11/1989 | Boundreau et al. | 473/175 |
| 5,362,044 | 11/1994 | Hageman | 473/175 |
| 5,451,045 | 9/1995 | Garske | 273/34 R |

*Primary Examiner*—Mark S. Graham

*Attorney, Agent, or Firm*—Zarley, McKee, Thomte, Voorhees & Sease

[57] ABSTRACT

A golf putting cup that includes an outer cylindrical wall and a bottom portion disposed therein. The bottom portion forms a ferrule socket and includes at least one passage for directing sand and other debris away from the ferrule socket. The ferrule socket is of minimal surface area to prevent sand or other material from becoming trapped between the ferrule and ferrule socket.

10 Claims, 2 Drawing Sheets

NON-STICKING PUTTING CUP

BACKGROUND OF THE INVENTION

The present invention relates generally to the field of golf course accessories, and more particularly, to a new golf putting cup that prevents sand and other debris from accumulating in the ferrule socket.

In recent years it has become a standard practice in golf course construction to construct golf greens with mostly sand. Loose sand frequently accumulates on the bottom surface of a traditional putting cup. Because the bottom surface slants towards the ferrule socket, sand tends to migrate to the ferrule socket. When the ferrule of the flagstick is inserted into the ferrule socket, sand and other debris become trapped therebetween. As a result, the ferrule becomes stuck in the ferrule socket, and the cup is often pulled out of the ground when the player attempts to remove the flagstick. Thus, there is a need in the art for a new golf putting cup that prevents the accumulation of sand and other debris in the ferrule socket.

One approach to the problem is disclosed in U.S. Pat. No. 5,451,045 issued Sep. 19, 1995. The '045 patent discloses a drainage ferrule having a plurality of valleys or grooves about its outer circumferential surface, allowing water, sand or other debris to pass through the socket while the ferrule is in the socket. This drainage ferrule does not, however, prevent the accumulation of sand and other debris in the ferrule socket. As such, there is still a need in the art for a new putting cup that directs sand and other debris away from the ferrule socket.

Accordingly, a primary objective of the present invention is the provision of an improved golf putting cup.

A further objective of the present invention is the provision of a golf putting cup that effectively prevents sand and other debris from accumulating in the ferrule socket.

Another objective of the present invention is the provision of a golf putting cup that allows the ferrule of a flagstick to be easily inserted and removed.

A still further objective of the present invention is an improved method for using a flagstick and a golf putting cup.

Another objective of the present invention is the provision of a golf putting cup that is efficient in operation, economical to manufacture, and durable in use.

These and other features, objectives and advantages will become apparent to those skilled in the art with reference to the accompanying specification.

SUMMARY OF THE INVENTION

The golf putting cup of the present invention includes an outer cylindrical wall and a bottom portion disposed within the outer wall, the bottom portion forming a ferrule socket and at least one passage for directing sand and debris away from the ferrule socket. In its preferred form, the putting cup includes a plurality of fins spaced apart and arranged vertically in the cup. The fins extend from a first end near the outer wall of the cup to a second end near the center of the cup. The second ends of the fins define the ferrule socket. That is, the ferrule is held in place by the second ends of the fins spaced apart near the center of the cup. The fins are tied together for strength by a substantially horizontal band. The band has a top surface that slants downwardly and away from the ferrule socket to direct sand and other debris away from the ferrule socket.

The present invention also includes a method of using a flagstick with a golf putting cup to prevent sand and other debris from accumulating in the ferrule socket. The method generally comprises the steps of providing a flagstick with a ferrule secured to its bottom end; providing a golf putting cup that includes a plurality of fins spaced apart with the ends of the fins defining a ferrule socket; and inserting the ferrule of the flagstick into the ferrule socket.

DETAILED DESCRIPTION OF THE PREFERRED EMBODIMENT

The present invention will be described as it applies to its preferred embodiment. It is not intended that the present invention be limited to the described embodiment. It is intended that the invention cover all alternatives, modifications, and equivalents which may be included within the spirit and scope of the invention.

Figure 1:
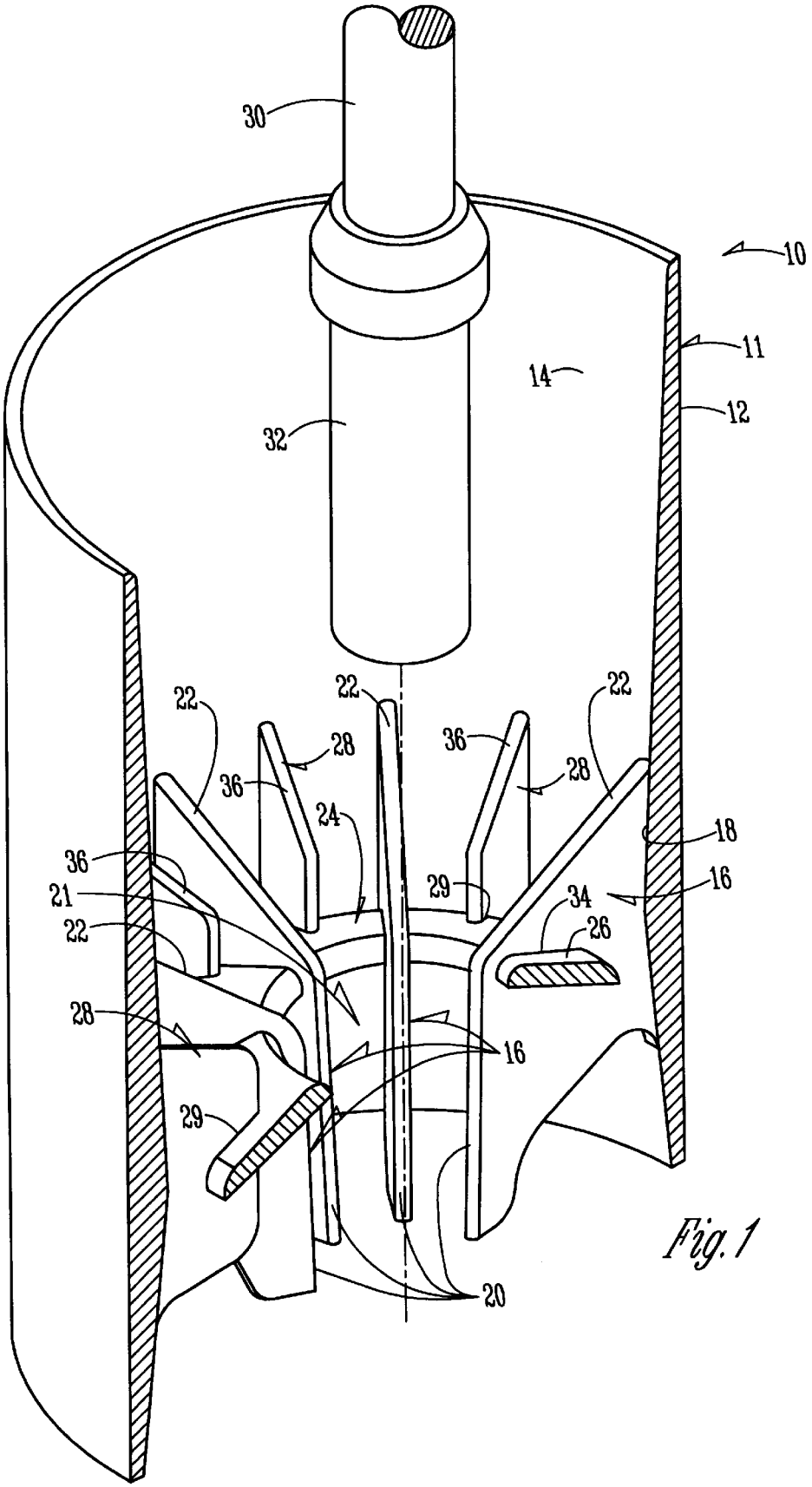
FIG. 1 is a perspective view of the golf putting cup of the present invention.

FIG. 1 shows the golf putting cup 10 of the present invention. The outer cylindrical wall 11 forms the periphery of the putting cup 10. The outer cylindrical wall includes an outer surface 12 and an inner surface 14. FIG. 1 also shows a typical golf flagstick 30 with a ferrule 32 mounted to its bottom end.

The putting cup has a bottom portion that includes a plurality of primary fins 16 are spaced apart adjacent the inner surface 14 of the outer cylindrical wall 11. The primary fins 16 are maintained in a generally vertical direction and extend between a first end 18 at or proximate the inner surface 14 of the outer cylindrical wall 11 toward the center of the cup to a second end 20. It is the second ends 20 of the primary fins 16 that form the ferrule socket 21. Because the second ends 20 of the primary fins 16 are spaced apart, the structure defining the ferrule socket 21 has a small surface area. As a result, there is less surface area for sand and other debris to accumulate and become trapped between the ferrule 32 and the ferrule socket 21.

Figure 2:
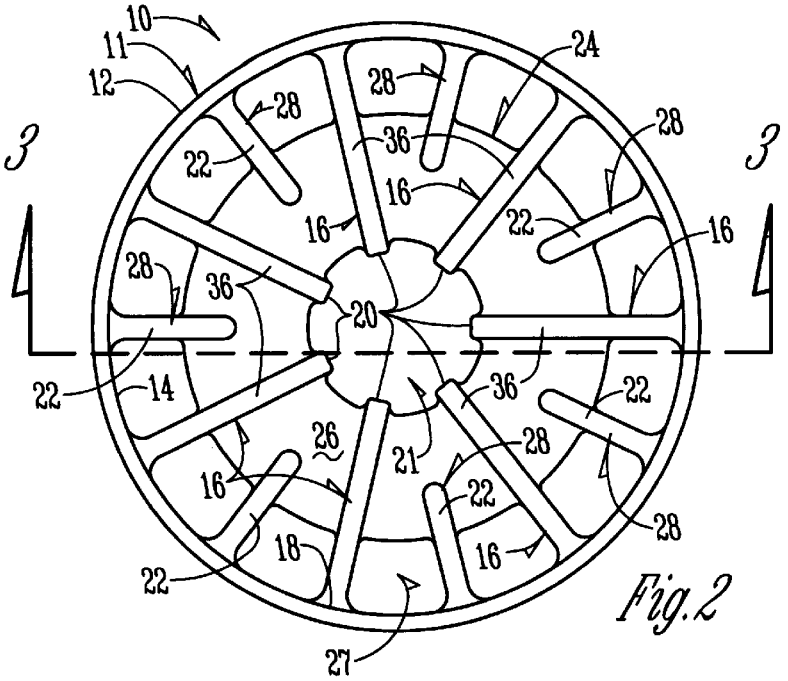
FIG. 2 is a top elevational view of the golf putting cup of FIG. 1.

The primary fins 16 are tied together for strength by a substantially horizontal band 24. Unlike the bottom of a traditional putting cup, however, this band 24 has a top surface 26 that slants downwardly and away from the ferrule socket 21. Therefore, any sand or other debris falling onto the band 24 is directed towards the outside of the cup and will fall through the space 27 between the band 24 and the inner surface 14 of the outer cylindrical wall 11 (see FIG. 2). The band 24 passes through an aperture 34 in each of the primary fins 16 to hold the fins together (See FIG. 3).

Figure 3:
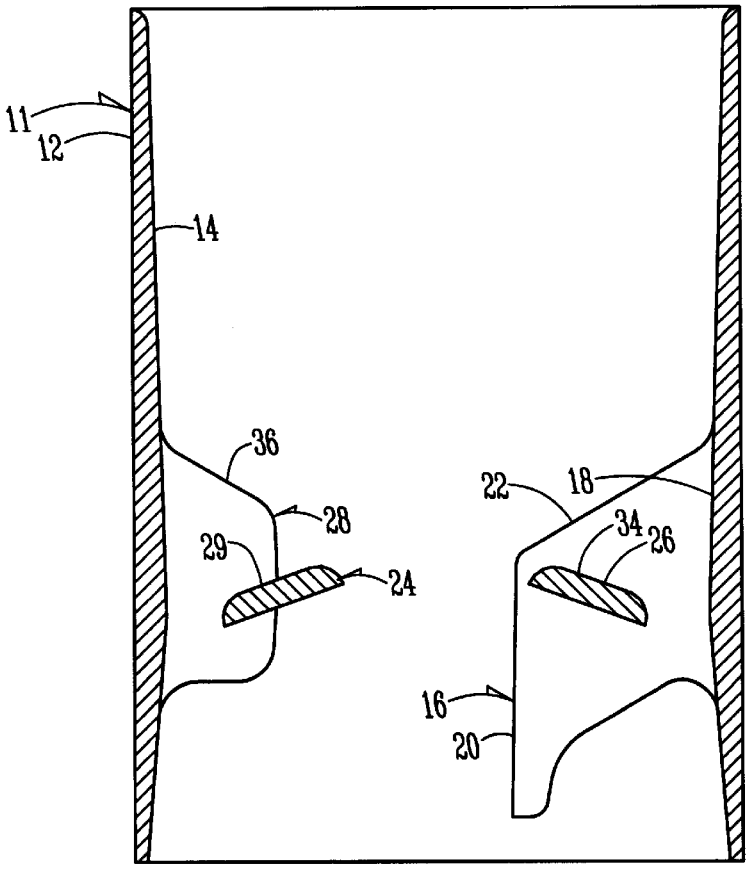
FIG. 3 is a cross-sectional view taken along line 3—3 of FIG. 2.

A plurality of minor fins 28 are also provided which provide reinforcement for the bottom portion of the cup and also prevent the ferrule 32 from accidentally becoming jammed between the major fins 16. Note that both the major fins 16 and the minor fins 28 are rounded at their top edges 22 and 36 to prevent the accumulation of debris. As shown in FIG. 3, each minor fin 28 includes a slot 29 for accepting the band 24. This provides reinforcement for the band 24 and helps to secure the major fins 16 to one another.

It is preferred that all components of the putting cup 10 of the present invention be made from a hardened plastic material. Alternataively, the putting cup may be cast from aluminum or diecast from zinc.

The present invention solves the problems associated with sand and other debris by essentially eliminating any surfaces within the cup in which debris can accumulate. In operation, any sand falling on the band 24 is directed away from the ferrule socket 21 and towards the outside of the putting cup. Thus, large amounts of sand and other debris does not accumulate in the ferrule socket 21. Further, when the ferrule 32 is inserted into the ferrule socket 21, there is not a large surface area for the sand to become trapped between the second ends 20 of the major fins 16 and the ferrule 32. As such, the ferrule 32 may be easily inserted and removed without sticking against the walls of the ferrule socket 21.

Whereas the invention has been shown and described in connection with the preferred embodiment thereof, it will be understood that many modifications, substitutions and additions may be made which are within the intended broad scope of the following claims.

From the foregoing, it can be seen that the present invention accomplishes at least all of its stated objectives.

What is claimed is:

1. A golf putting cup comprising:

an outer cylindrical wall having an inner surface;

a plurality of primary fins spaced apart within said outer wall, each of said fins extending inward from a first end proximate said inner surface to a second end, said second ends of said fins defining a ferrule socket; and a band extending through and between each of said fins, said band having a top surface slanted downwardly and away from said ferrule socket.

2. The golf putting cup of claim 1 wherein said fins are arranged in a generally vertical direction.

3. The putting cup of claim 1 wherein each of said fins has a top edge slanted downwardly toward said ferrule socket.

4. The putting cup of claim 3 wherein said top edge of each of said fins is rounded.

5. The golf putting cup of claim 1 wherein said fins adjacent each other and said band define a passage for directing sand and other debris away from said ferrule socket.

6. A method of using a golf flagstick with a golf putting cup to prevent sand and other debris from accumulating in a ferrule socket of said golf putting cup, said method comprising:

providing a flagstick having a top end and a bottom end and a ferrule secured to said bottom end;

providing a golf putting cup that includes an outer cylindrical wall having an inner surface, a plurality of primary fins spaced apart within said cylindrical wall, each of said fins extending inward from a first end proximate said inner surface to a second end, said second ends of said fins defining a ferrule socket, a band extending through and between each of said fins and having a surface slanted downwardly and away from said ferrule socket; and inserting said ferrule of said flagstick into said ferrule socket.

7. The method of claim 1 wherein said fins each have a top edge slanted downwardly toward said ferrule socket.

8. The method of claim 7 wherein said top edge of each of said fin is rounded.

9. The method of claim 6 wherein said fins adjacent each other and said band define a passage for directing sand and other debris away from said ferrule socket.

10. The method of claim 6 wherein said fins are arranged in a generally vertical direction.

* * * * *